US006742839B2

(12) United States Patent
Piretti

(10) Patent No.: US 6,742,839 B2
(45) Date of Patent: Jun. 1, 2004

(54) STACKABLE CHAIR

(75) Inventor: Giancarlo Piretti, Bologna (IT)

(73) Assignee: Pro-Cord Spa, Bologna (IT)

( * ) Notice: Subject to any disclaimer, the term of this patent is extended or adjusted under 35 U.S.C. 154(b) by 0 days.

(21) Appl. No.: 10/262,416

(22) Filed: Sep. 30, 2002

(65) Prior Publication Data

US 2003/0090137 A1 May 15, 2003

(30) Foreign Application Priority Data

Oct. 4, 2001 (IT) ..... TO2001A0940

(51) Int. Cl.[7] ..... A47C 3/04; A47C 4/00

(52) U.S. Cl. ..... 297/239; 297/55; 297/296; 297/354.11

(58) Field of Search ..... 297/16.2, 19, 21, 297/23, 55, 239, 354.11, 285, 296, 294

(56) References Cited

U.S. PATENT DOCUMENTS 529,645 A * 11/1894 Clark ..... 297/55
556,418 A * 3/1896 Hubbard ..... 297/55
2,011,067 A * 8/1935 McKee ..... 297/239
3,982,785 A * 9/1976 Ambasz ..... 297/239 X
4,157,203 A * 6/1979 Ambasz ..... 297/354.11 X
4,549,764 A * 10/1985 Haedo ..... 297/296
4,580,836 A * 4/1986 Verney ..... 297/296
4,603,904 A * 8/1986 Tolleson et al. ..... 297/296
4,703,974 A * 11/1987 Brauning ..... 297/285
4,869,552 A * 9/1989 Tolleson et al. ..... 297/296
5,524,966 A * 6/1996 Piretti ..... 297/55 X
5,904,397 A * 5/1999 Fismen ..... 297/296 X
6,478,379 B1 * 11/2002 Ambasz ..... 297/354.11
6,481,789 B1 * 11/2002 Ambasz ..... 297/55

* cited by examiner

*Primary Examiner*—Peter M. Cuomo
*Assistant Examiner*—Rodney B. White
(74) *Attorney, Agent, or Firm*—TraskBritt

(57) ABSTRACT

A chair comprising a supporting structure (12) having a pair of front legs **(20*a*) and a pair of rear legs (22) and carrying a seat (14) and a backrest (16). The supporting structure (12) comprises a transverse element (18), a first pair of bars (20) fixed to the ends of the transverse element (18) and forming the pair of front legs, and a second pair of bars (22) fixed to the ends of the transverse element (18)** and forming the pair of rear legs.

9 Claims, 8 Drawing Sheets

16
X
10
20b
14
V
12
51
18
20
22
22
16
20a
60
20
60
60
20a
62
62
62
62

14
20b
10
22
51
20
20a
60
60
62
62

14
20b
52
51
16
18

26
22
38
10
20
20a
20b
IX
IX
20
51
20a
22
60
60
62
62

16
10
XI
70
66
XIII
68
64
14
20b
XI
96
98
76
20a
18
22
88
20

90
78
72
100
86
94
80
92
84
82

STACKABLE CHAIR

The present invention relates to a chair designed, in particular, for being used in places where congresses, meetings, shows and the like are held.

The chairs designed for this type of use must be characterized by a sturdy and comfortable structure. A characteristic that is particularly appreciated in chairs designed for events of any kind, such as meetings, shows and the like is that they may be stacked or set up against one another so as to reduce the space occupied when they are not in use. A further characteristic of particular importance is that the chair should enable, mass production by means of simple and readily automatable operations, without, however, penalizing the aesthetic aspect and comfort for the user.

With the purpose of satisfying the aforesaid requirements, the subject of the present invention is a chair having the characteristics forming the subject of the annexed claims.

The present invention will now be described in detail with reference to the attached drawings, which are provided purely by way of non-limiting example and in which.

Figure 1:
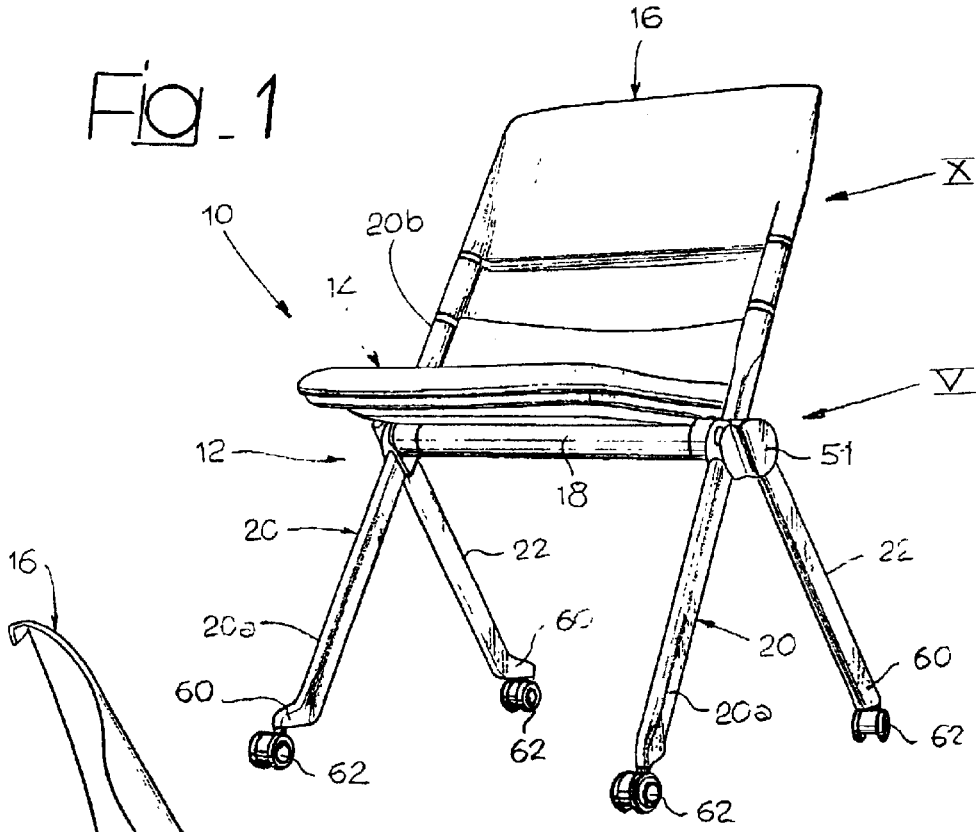
FIG. 1 is a perspective view of a chair according to the present invention.
Figure 2:
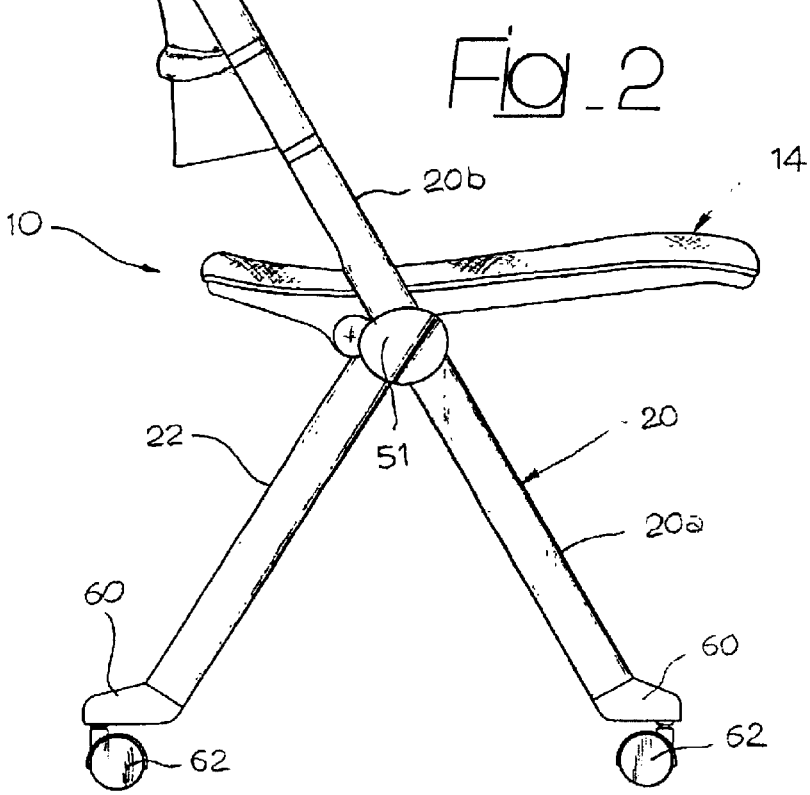
FIG. 2 is a side view of the chair of FIG. 1.
Figures 3, 7:
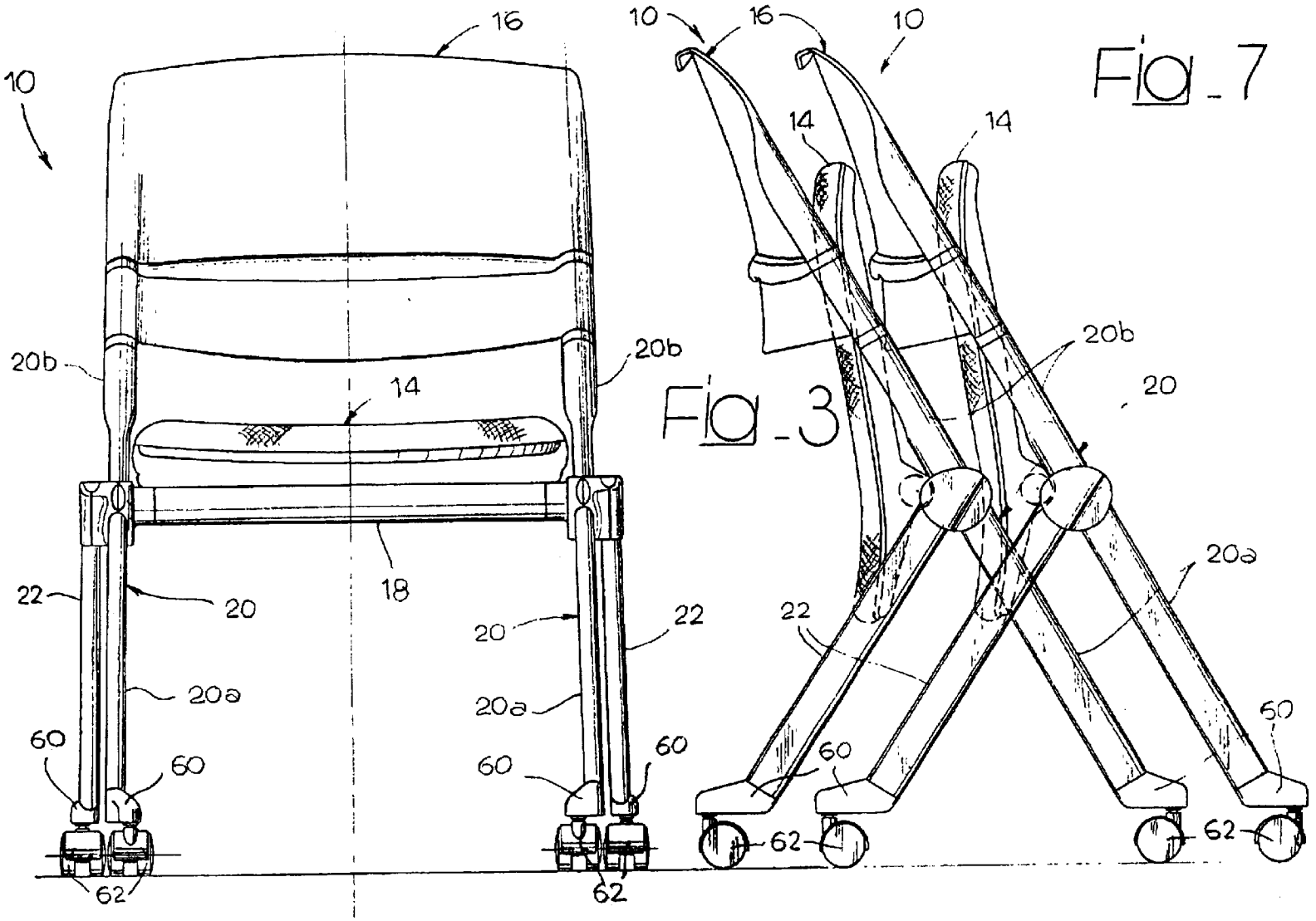
FIG. 3 is a front view of the chair of FIG. 1.
FIG. 7 illustrates two chairs according to the present invention set up against one another in a longitudinal direction.

With reference to FIGS. 1 to 3, the reference number 10 designates a chair according to the present invention. The chair 10 comprises a supporting structure 12, a seat 14 and a backrest 16. The supporting structure 12 comprises a transverse element 18 to the ends of which are fixed a first pair of bars 20 and a second pair of bars 22, preferably made of metal material such as aluminium alloy or the like. The bars 22 constitute a pair of rear legs of the chair 10 and terminate at their top end at the transverse element 18. The bars 20 have bottom portions 20*a* that form the front legs of the chair 10 and top portions 20*b* that form part of the supporting structure of the backrest 16.

Figures 4, 5:
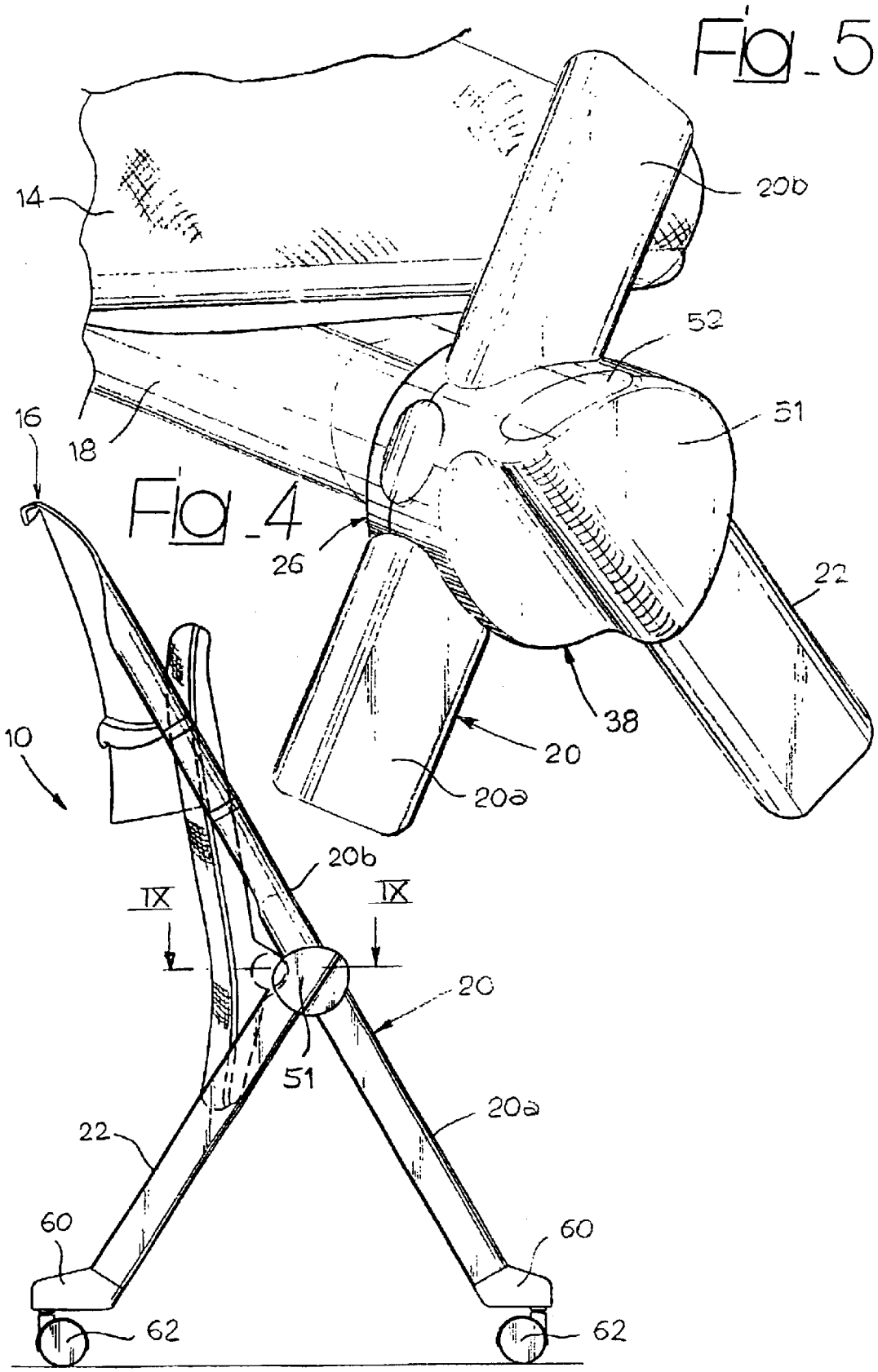
FIG. 4 is a side view illustrating the chair according to the invention with the seat in the raised position.
FIG. 5 is a perspective view at a larger scale of the part indicated by the arrow V in FIG. 1.
Figure 6:
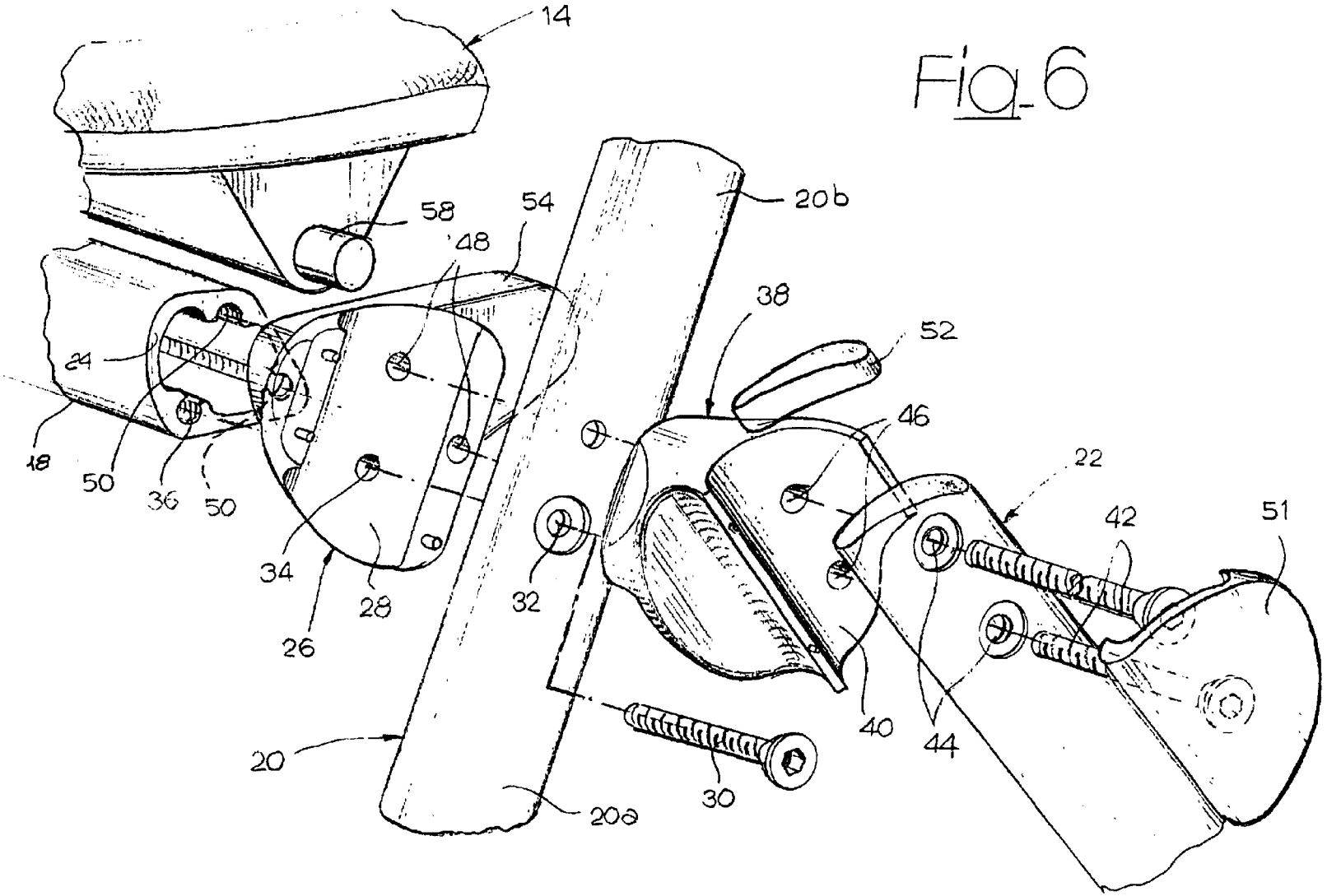
FIG. 6 is a perspective view of the part indicated by the arrow VI in FIG. 5.

With reference to FIGS. 5 and 6, there will now be described the way in which the bars 20 and 22 are fixed to the transverse element 18. On each end face 24 of the transverse element 18 there is applied a first fixing element 26 having a seat 28 on its side opposite to the one facing the transverse element 18. The seat 28 is designed to receive a portion of a bar 20. A first screw 30 is inserted through a hole 32 of the bar 20, through a hole 34 of the first fixing element 26, and engages a threaded hole 36 of the transverse element 18. The shape of the seat 18 is defined so as to impart on the respective bar 20 a pre-set inclination with respect to the transverse element 18. A second fixing element 38 is then applied on the outer face of the bar 20. The second fixing element 38 has a first seat having a shape complementary to that of the seat 28 of the first fixing element 26 facing the bar 20. The second fixing element 38 has a second seat 40 designed to receive the second bar 22, shaped so as to maintain the second bar 22 with a pre-set inclination with respect to the first bar 20 and to the transverse element 18. The second bar 22 is fixed to the transverse element 18 by means of a pair of screws 42, which extend through holes 44 of the second bar 22, through holes 46 of the second fixing element 38, through holes 48 of the first fixing element 26, and engage threaded holes 50 of the transverse element 18. The assembly can be completed by means of the application of a side lid or cover 51 fixed on the outside of the bar 22. At the top of the bar 22 there is preferably applied a closing element 52.

Figure 9:
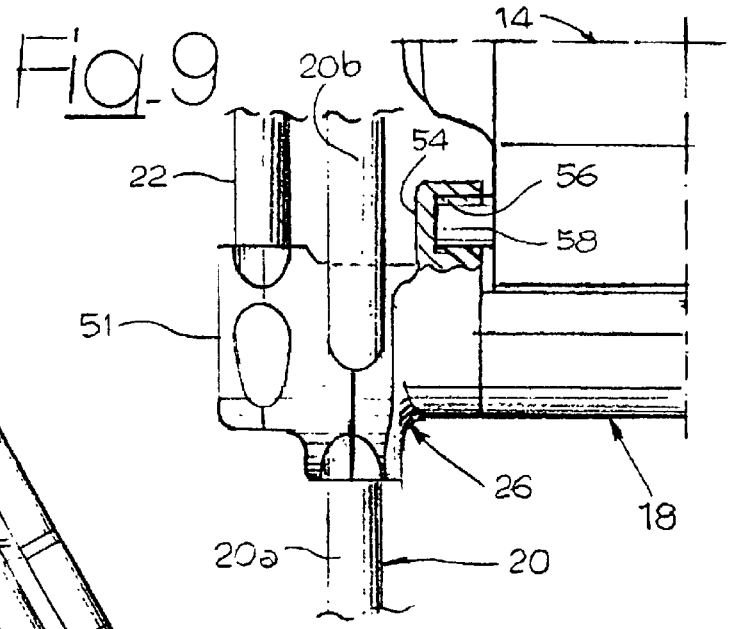
FIG. 9 is a section according to the line IX—IX of FIG. 4.

With reference to FIGS. 6 and 9, the first fixing element 26 has an appendage 54, in which there is formed a cylindrical seat 56, within which there is inserted, in such a way that it can turn, a pin 58 carried by the seat 14. In this way, the seat 14 is connected to the basic structure 12 in a way articulated about a transverse axis parallel to the transverse element 18 and displaced towards the rear part of the chair with respect to the transverse element 18. The seat 14 is consequently mobile between a raised, inoperative, position illustrated in FIG. 4 and a lowered, operative, position illustrated in FIG. 2. It is important to note that, in the lowered position of FIG. 2, the seat 14 rests against the top surface of the transverse element 18. The said transverse element 18, in addition to being a structural element that keeps the two sides of the chair joined together, also constitutes an element of support and end-of-travel or detent for the seat 14.

The fixing system previously described causes the bars 22 that form the rear legs to be displaced laterally with respect to the respective bars 20 that form the front legs. The distance between each bar 22 and the corresponding bar 20 is determined by the thickness of the second fixing element 38. The distance in a transverse direction between the bars 20, 22 is equal to or greater than the thickness of each outer bar 22. In this way, two chairs of the same type with the respective seats 14 raised in the inoperative position can be set up against one another and slid into one another in a longitudinal direction, as illustrated in FIG. 7. Preferably, the bottom ends of the legs 20, 22 carry feet 60 having guiding surfaces that facilitate the manoeuvre of interpenetration between the chairs and, in particular, facilitate insertion of the front legs 20*a* between the rear legs 22 of a chair situated in front of it. Preferably, the feet 60 carry respective pivot wheels 62.

Figure 8:
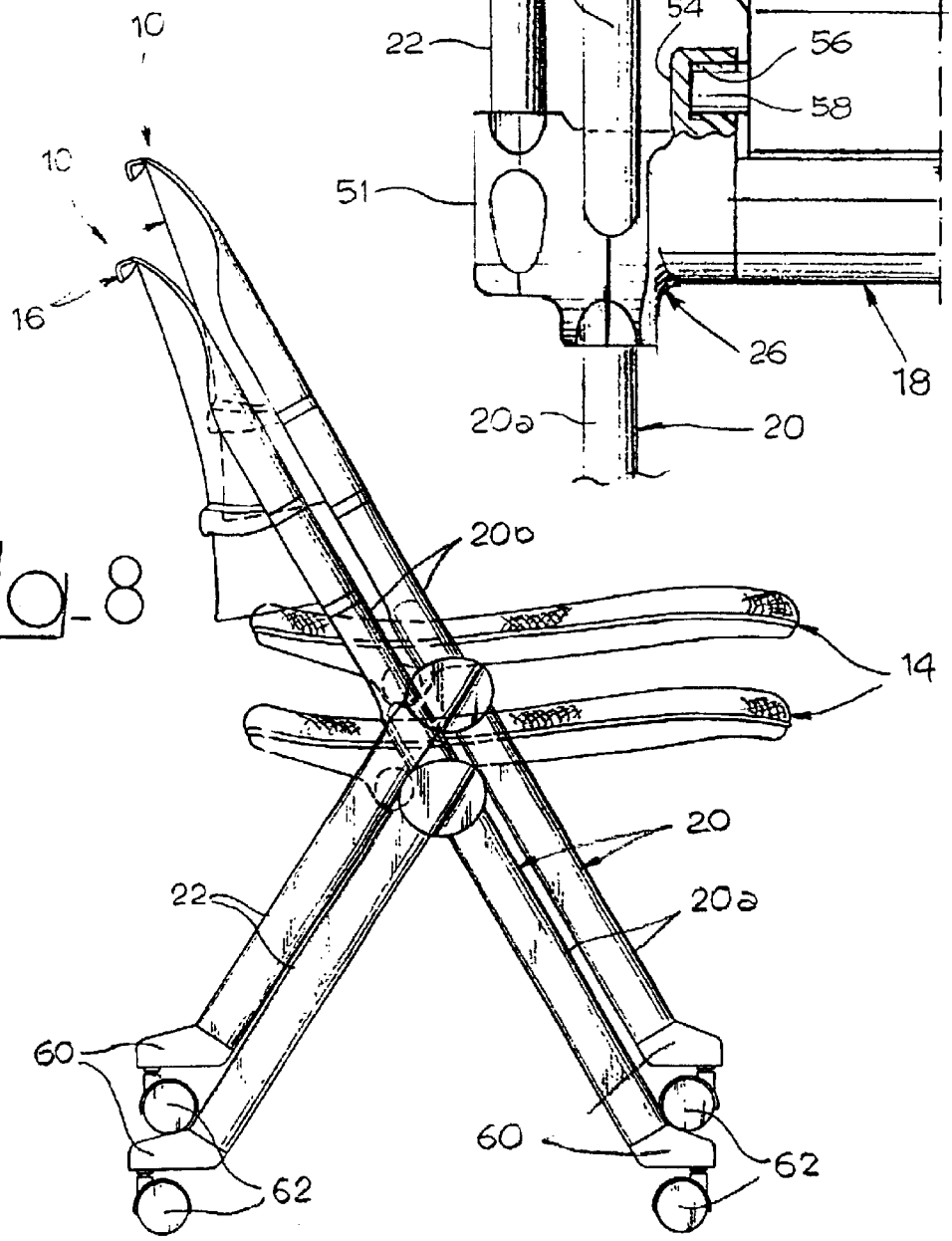
FIG. 8 illustrates two chairs according to the present invention stacked on top of one another.

The chairs according to the present invention can also be stacked together as illustrated in FIG. 8, with the seats 14 in the lowered position.

The chair according to the present invention can hence be stacked away out of use in the most convenient way, i.e., according to an arrangement whereby they are slid into one another longitudinally or else stacked vertically on top of other chairs of the same type. The structure of the chair according to the invention is suited for being mass produced in a very fast and readily automatable way, above all thanks to the absence of welds between the various components of the chair.

Figure 11:
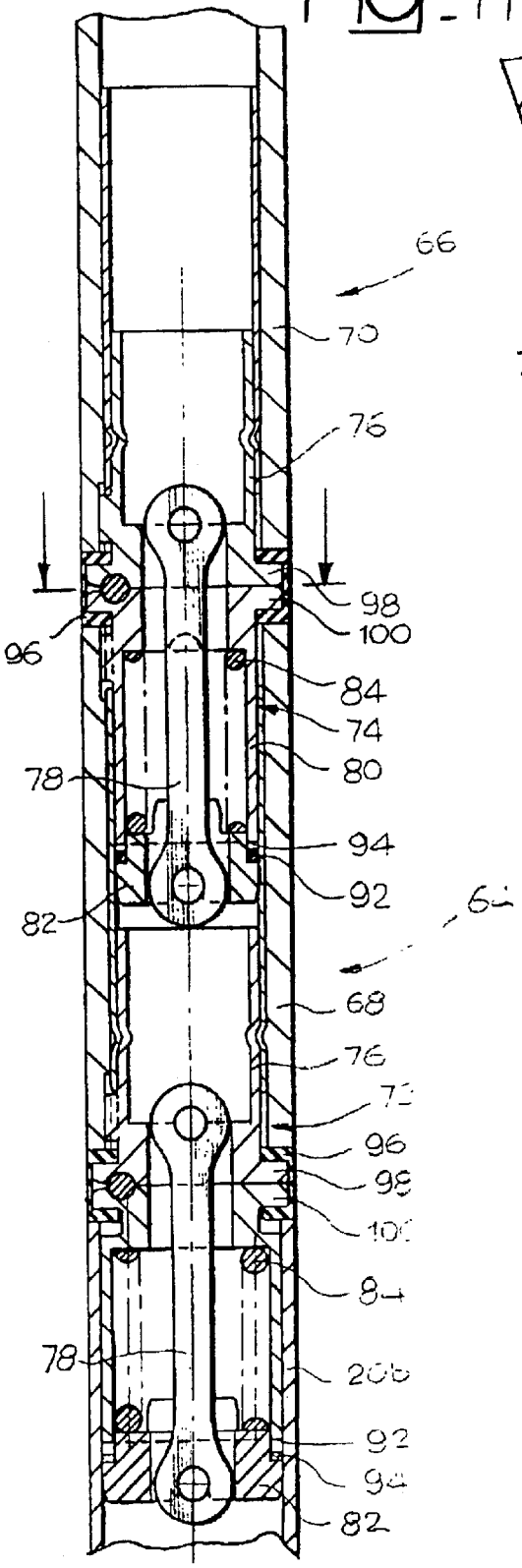
FIG. 11 is a cross-sectional view according to the line XI—XI of FIG. 10.
Figure 12:
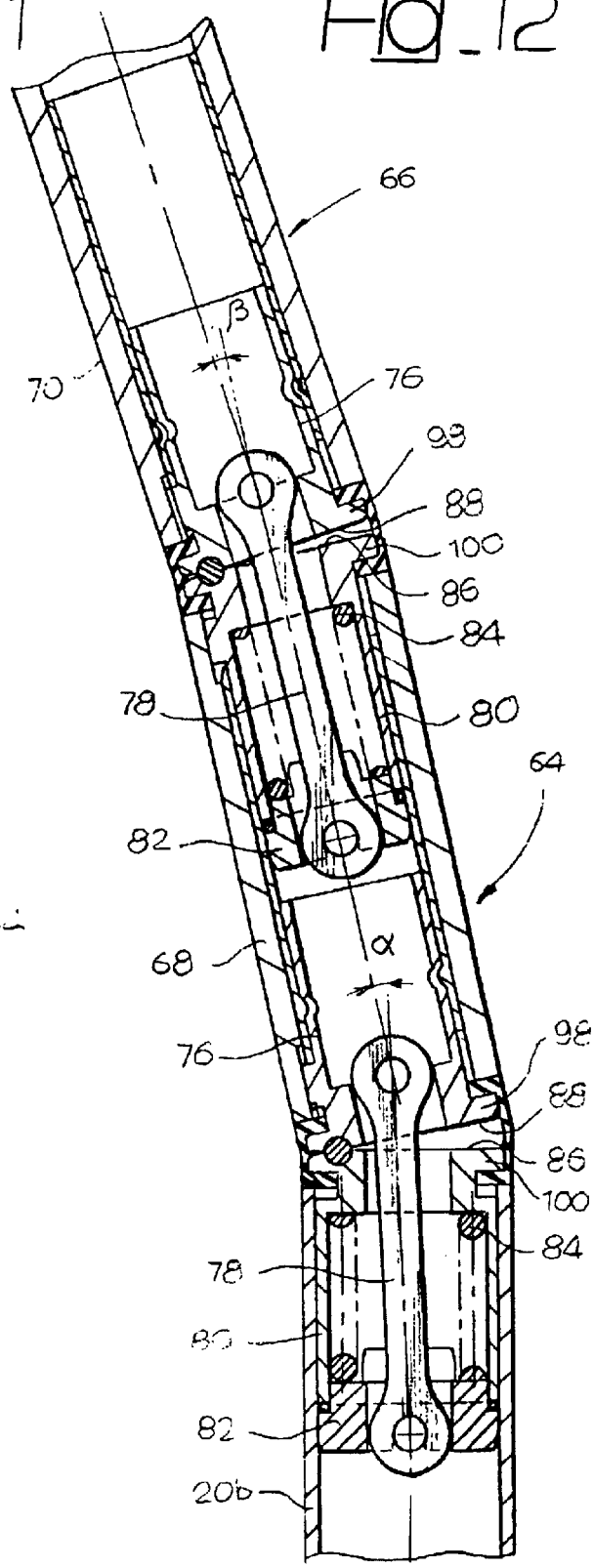
FIG. 12 is a cross-sectional view similar to that of FIG. 11 in a second operative position.
Figures 13, 15:
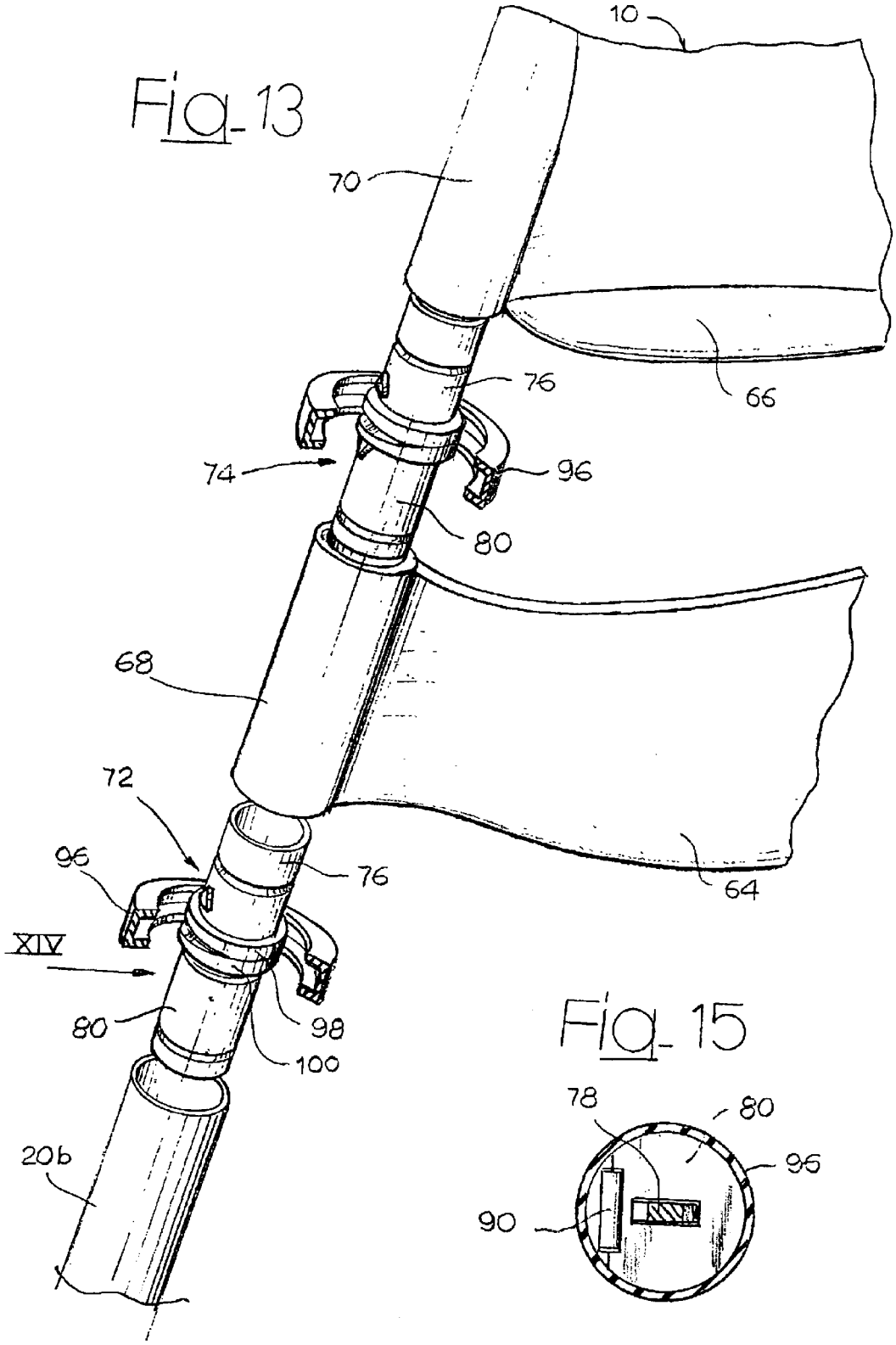
FIG. 13 is an exploded perspective view of the part indicated by the arrow XIII in FIG. 10.
FIG. 15 is a cross-sectional view according to the line XV—XV of FIG. 11.

With reference to FIGS. 10 to 15, the backrest 16 of the chair according to the present invention is preferably formed by two sections oscillating independently with respect to one another about respective transverse axes. More precisely, the backrest 16 comprises a bottom section 64 and a top section 66. Both of the sections of backrest 64, 66 have a pair of tubular portions 68, 70, which, in conditions of rest, are aligned with portions 20*b* of the bars 20. With reference to FIG. 13, each tubular portion 68 of the bottom section of backrest 64 is connected to the respective bar 20*b* by means of a first elastic return device 72. In a similar way, each tubular portion 70 of the top section of backrest 66 is connected to the tubular portion 68 of the bottom frame section 64 by means of a second elastic return device 74.

Figures 10, 14:
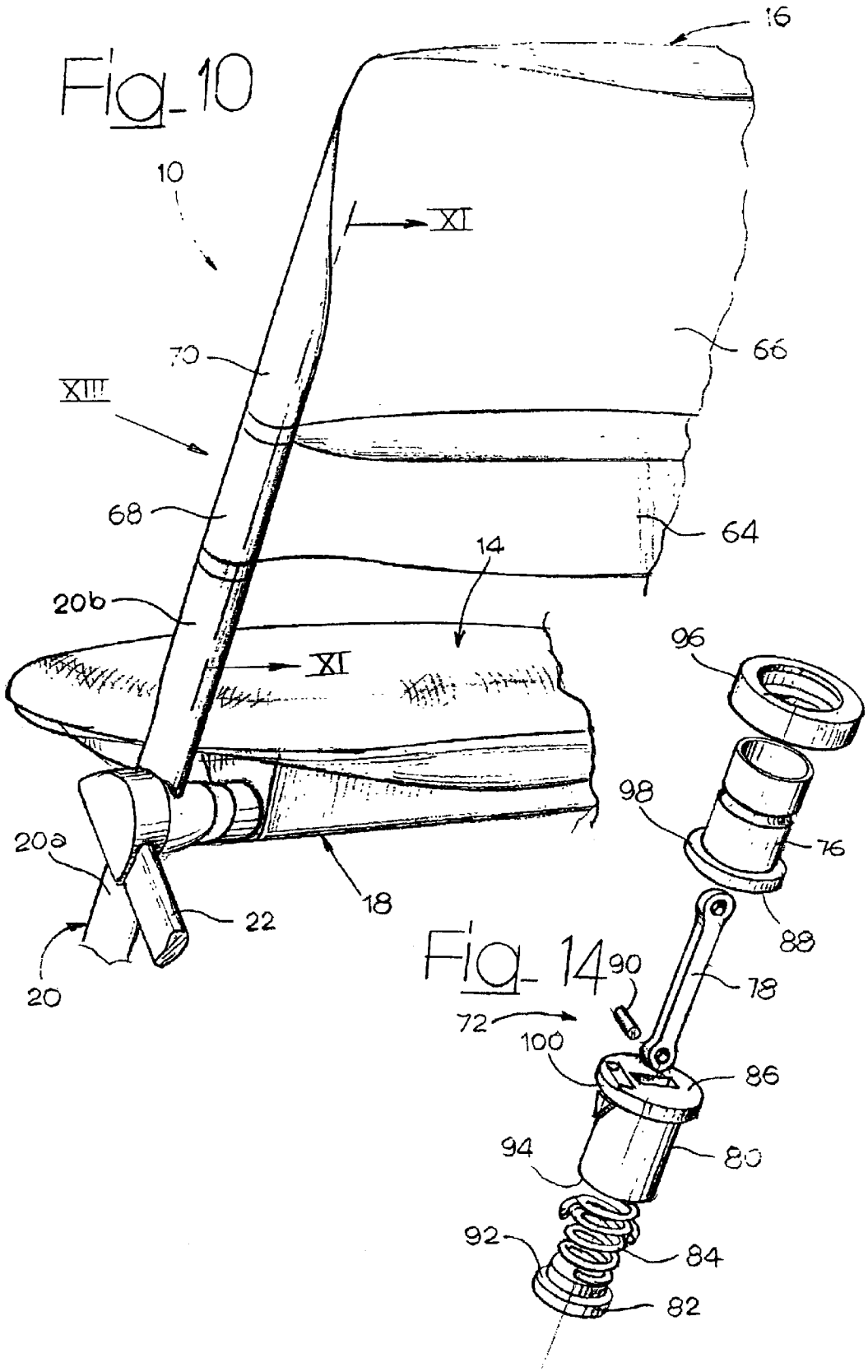
FIG. 10 is a partial perspective view according to the arrow X of FIG. 1.
FIG. 14 is an exploded perspective view of the device indicated by the arrow XIV in FIG. 13.

With reference to FIG. 14, each elastic return device 72, 74 comprises a top tubular member 76, a tie-rod 78, a bottom tubular member 80, a sliding element 82 and an elastic element 84. The tie-rod 78 is articulated to the top tubular member 76 at its top end and is articulated to the sliding element 82 at its bottom end. The elastic element 84 consists of a helical spring in compression set between the sliding element 82 and an inner bottom wall of the bottom tubular member 80. The thrust of the spring 84 tends to maintain the two tubular elements 76, 80 in contact and in a mutually aligned position. On the surfaces of mutual contact 86, 88 of the two tubular elements 76, 80 there is set a pin 90 that defines an axis of relative oscillation between the tubular elements 76, 80. The mutual oscillation between the tubular elements 76, 80 about the axis of the pin 90 produces the compression of the spring 84. The maximum angle of relative inclination between the tubular elements 76, 80 is defined by the maximum travel of the sliding element 82 with respect to the bottom tubular member 80. The sliding member 82 has a shoulder 92 that is designed to come to bear upon an edge 94 of the bottom tubular member 80 in the condition of maximum relative inclination between the tubular elements 76 and 80. Each elastic return element 72, 74 further comprises a protective ring made of deformable material 96, which embraces two shoulders 98, 100 of the tubular elements 76, 80. With reference to FIGS. 11 and 13, the tubular member 80 of the elastic return device 72 is inserted and fixed inside the top end of the bar 20*b*, whilst the tubular member 76 of the same elastic return device is inserted and fixed inside the tubular portion 68 of the bottom backrest element 64. In the same way, the bottom tubular member 80 of the elastic return device 74 is fixed inside the tubular portion 68 of the bottom backrest element 64, whilst the top tubular member 76 of the elastic return device 74 is fixed inside the tubular portion 70 of the top backrest element 66.

FIG. 12 illustrates the position of the elastic return means 72 and 74 in the condition of maximum inclination backwards of the backrest 16. The maximum angle of inclination $\alpha$ of the elastic return device 72 is greater than the maximum angle of inclination of the top elastic return device 74, indicated by $\beta$. Preferably, the maximum angle of inclination $\alpha$ is approximately twice that of the maximum angle of inclination $\beta$. For example, the angle of inclination $\alpha$ could be approximately 12° whilst the angle of inclination $\beta$ could be approximately 6°. This condition enables maximum comfort for the occupier in so far as the portions of backrest 64 and 66 are disposed in the condition of maximum inclination backwards according to a curved surface similar to that of the natural curvature of the back of the occupier.

Of course, without prejudice to the principle of the invention, the details of construction and the embodiments may be amply varied with respect to what is described and illustrated herein, without thereby departing from the scope of the present invention as defined by the ensuing claims.

What is claimed is:

1. A chair comprising a fixed supporting structure having a pair of front legs and a pair of rear legs and carrying an oscillating seat moveable between a raised position and a lowered position and a backrest, the supporting structure comprising:

a transverse element, with two lateral end faces and a top support surface, a first pair of fixing elements fixed to respective end faces of the transverse element, the first pair of fixing elements having respective rearward projection portions, the seat being articulated to said rearward projecting portions about a transverse articulation axis parallel to the transverse element and displaced rearward with respect to the transverse element in such a way that in the lowered position the seat rests against said top support surface, a first pair of bars fixed to the first pair of fixing elements, the first pair of bars having lower portions extending below the transverse element and forming the pair of front legs, and top portions extending above the transverse element and forming a backrest support, a second pair of fixing elements fixed to the first pair of bars, and a second pair of bars fixed to the second pair of fixing elements, and forming the pair of rear legs, wherein the bars forming the rear legs are staggered in a transverse direction with respect to the respective bars forming the front legs.

2. The chair according to claim 1, wherein the first and second pair of bars, and the first and second fixing element are fixed to transverse element by means of screws.

3. The chair according to claim 2, wherein the first fixing element and the second fixing element have respective seats that withhold the respective bars with a pre-set inclination with respect to the transverse element.

4. The chair according to claim 3, comprising a first pair of elastic return means set between the top ends of the first pair of bars and the bottom section of backrest, and a second pair of elastic return means set between the bottom section of backrest and the top section of backrest.

5. The chair according to claim 1, wherein the axis of articulation of the seat is formed by a pair of pins provided on the seat rotatably mounted into respective seats of said rearward projection portions of the first pair of fixing elements.

6. The chair according to claim 5, wherein said first pair of elastic return means has a maximum angle of inclination greater than the maximum angle of inclination greater than the maximum angle of inclination of the second pair of elastic return means.

7. The chair according to claim 5, wherein each of said elastic return means comprises a pair of tubular elements connected together by means of a tie-rod cooperating with an elastic element, which tends to maintain the said tubular elements in a mutually aligned position.

8. The chair according to claim 1, wherein the backrest comprises a top section of backrest and a bottom section of backrest oscillating independently about respective transverse axes.

9. The chair according to claim 8, wherein the maximum angle of inclination of the first pair of elastic return means is substantially twice that of the maximum angle of inclination of the first pair of elastic return means is substantially twice that of the maximum angle of inclination of the second pair of elastic return means.

* * * * *